United States Patent [19]

Ruff

[11] 4,122,685

[45] Oct. 31, 1978

[54] ELEVATOR SHAFT

[75] Inventor: Alonzo W. Ruff, York, Pa.

[73] Assignee: St. Onge, Ruff & Associates, Inc., York, Pa.

[21] Appl. No.: 782,453

[22] Filed: Mar. 29, 1977

[51] Int. Cl.[2] ..... F25D 21/00

[52] U.S. Cl. ..... 62/80; 52/30; 62/259

[58] Field of Search ..... 62/80, 259, 275; 52/30

[56] References Cited

U.S. PATENT DOCUMENTS

| | | | |
|---|---|---|---|
| Re. 12,300 | 1/1905 | Wills | 52/30 |
| 2,787,139 | 4/1957 | Salazar | 62/259 |
| 3,135,100 | 6/1964 | Taylor et al. | 62/275 |
| 3,149,476 | 9/1964 | Beckwith | 62/275 X |
| 3,376,406 | 4/1968 | Phelps | 62/80 X |
| 3,830,078 | 8/1974 | Read | 62/80 X |

*Primary Examiner*—William E. Wayner
*Assistant Examiner*—William E. Tapolcai, Jr.
*Attorney, Agent, or Firm*—Kemon & Estabrook

[57] ABSTRACT

An elevator shaft in a multi-story cold storage warehouse is modified to substantially isolate the atmosphere in the shaft from that in the warehouse and also from the ambient. Small amounts of heat are then added to the shaft and also means to cause positive circulation of the shaft atmosphere to prevent build up of frost and ice on the shaft interior, the elevator car, the cables and other parts within the shaft.

2 Claims, 2 Drawing Figures

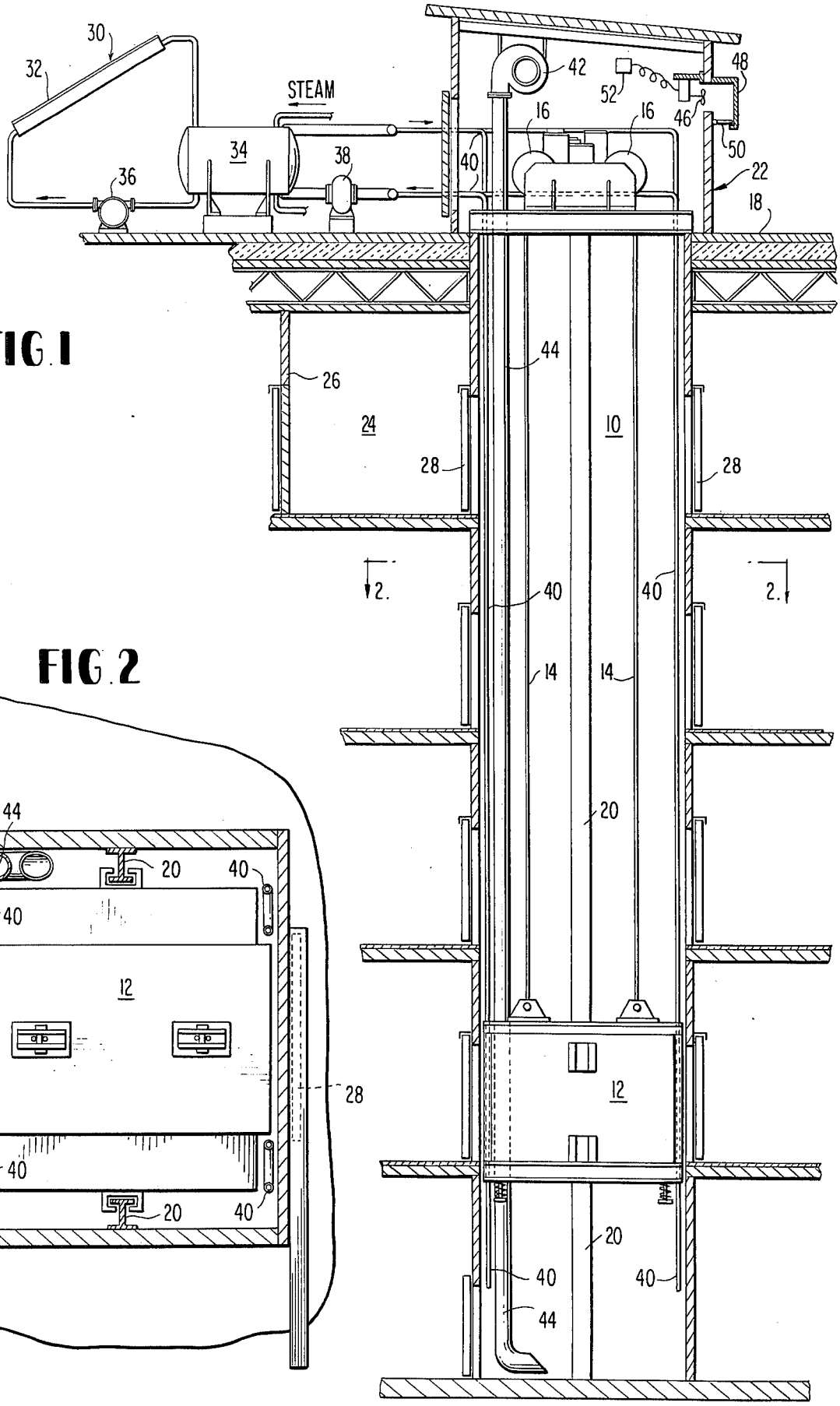
FIG. 1
FIG. 2
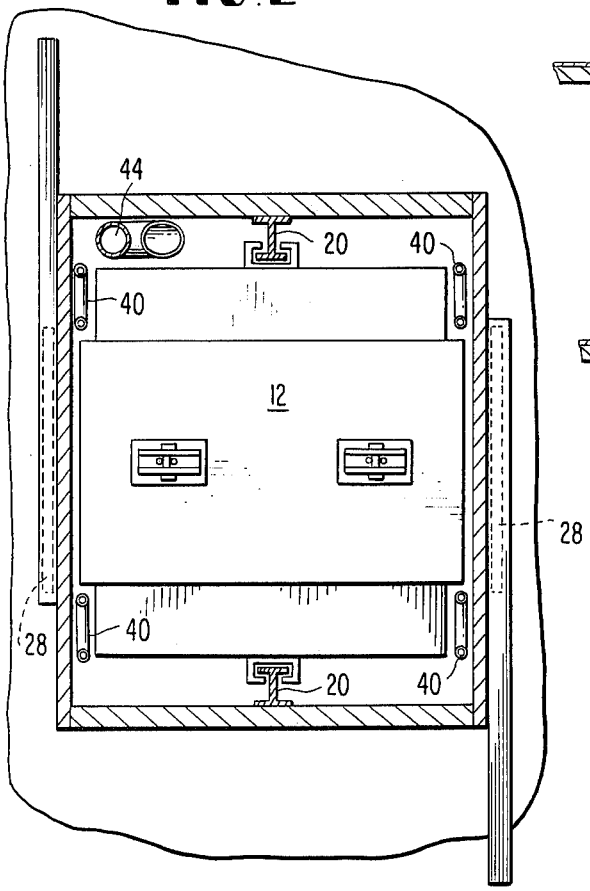

ELEVATOR SHAFT

BACKGROUND OF THE INVENTION

There are numerous multi-story cold storage warehouses in this country having interiorly disposed elevator shafts which are partially or completely surrounded by the cold storage area the temperature of which is usually maintained between 0° and −20° F. A constantly recurring problem in buildings of this type is the build up of frost and ice on all surfaces inside the elevator shaft. This is caused over a period of time by the condensation of moisture in the shaft on the exposed surfaces and subsequent freezing due to gradual transfer of heat from the shaft interior to the remainder of the cold storage area. Everytime that the elevator doors are opened, additional air enters the shaft and in addition there is a pumping effect due to movement of the elevator car within the shaft. At the present time, many such installations are permitted to continue to operate in this manner until the ice build up in the shaft is so excessive that it interferes with the operation of the elevator. The remedy in the past had been to employ workmen to ride in or on the elevator car and physically chip the ice from the surfaces where it has accumulated. This is not only an expensive procedure but also a dangerous one for the workmen concerned. Further, the existence of ice in this location can be detrimental to insulation and to the structure of the warehouse itself.

BRIEF SUMMARY OF THE INVENTION

In accordance with the present invention, an existing installation of the type described above is modified in a manner to substantially isolate the atmosphere in the elevator shaft from that in the surrounding warehouse and also from the ambient. Means are then provided for adding small amounts of heat to the interior of the shaft at fixed locations and to establish a positive circulation of the air within the shaft over the heat exchange means in order to maintain all interior surfaces at temperatures which will prevent condensation and freezing thereon.

BRIEF DESCRIPTION OF THE DRAWING

FIG. 1 is a side elevation partially in section of an elevator shaft modified in accordance with the present invention; and FIG. 2 is a section on the lines 2—2 of FIG. 1.

DETAILED DESCRIPTION OF THE INVENTION

Referring now to the drawing, FIG. 1 shows a partial section through a multi story warehouse having an interior elevator shaft 10 providing access to the several floors of the building. The elevator 12 is raised and lowered by means of the conventional cables 14 driven from hoists 16 located at the top of the shaft on the roof 18 of the warehouse structure. The guide rails for the elevator car are indicated at 20. A conventional penthouse 22 encloses the operating machinery for the elevator.

In order to isolate the elevator shaft from ambient, the penthouse should be sealed against air and moisture leakage. Movement of the elevator car within the shaft causes a pumping action and pressure variations which make the leakage from the ambient into the shaft and vice versa rather severe in the absence of an effective seal at this point.

A second part of the shaft isolation technique is to establish vestibules on each floor surrounding the elevator doors. One such vestibule is indicated at 24 in FIG. 1. This could take the form of a door extending completely between the ceiling and the floor as indicated at 26 or a vestibule of lesser height could be constructed. Either way, the movement of air between the cold storage area and the elevator shaft is minimized by having the movement of all warehouse items and or personnel between the cold storage area and the shaft take place through the double door vestibule structure. Insulation can also be added to the existing elevator doors 28 to further minimize the heat transfer problem.

With the shaft atmosphere effectively isolated, it then becomes a relatively simple job to add enough heat to the shaft interior to maintain the temperature therein at a level sufficient to prevent condensation or frost and ice build up. One economical possibility as a source of heat would be a solar heater as indicated at 30 in FIG. 1. This would include an absorber panel 32 and an insulated tank 34. A pump 36 is effective to circulate a fluid such as glycol between the absorber panel and the tank. A second pump 38 may be employed to circulate heated glycol from the tank through piping which extends the length of the elevator shaft as indicated at 40.

In order to insure circulation of the atmosphere within the shaft over the heating pipes 40 and all of the exposed surfaces within the shaft, a blower 42 is mounted in the penthouse and connected to an elongated flexible and collapsible plastic duct 44. The advantages of a plastic duct of this type are that the initial expense is very minor, it can be easily hung to extend from the top to the bottom of the shaft and is easily replaceable in the event that it is ever damaged. The arrangement nevertheless is effective to carry warm air from the penthouse to the service pit at the bottom of the shaft where it is released to rise through the shaft to the top to be recirculated.

Under some conditions, it may also be useful to add a thermostatically controlled exhaust fan to the penthouse. FIG. 1 indicates this possibility with the fan 46 mounted on an interior wall and surrounded by a weather shielding duct 48 having an outlet damper 50 normally closed by gravity. The Thermostat 52 can be placed in any convenient location within the penthouse. In this way, excess heat from the elevator motors, etc. can be removed and the fact that the shaft will then be under slightly negative pressure means that some leakage past the vestibule doors of dry inside air will occur. This of course will be warmed by the heating means in the shaft and may serve further to prevent condensation and icing on the shaft interior.

Obviously, sources of heat other than solar energy could be employed which would be equally and economically effective. In any cold storage warehouse of this type, there is often waste heat available from the condensors of the refrigeration system and it is believed that source would be entirely adequate for the small amount of heating required to keep the elevator shaft free of frost and ice.

While a preferred embodiment of the invention has been herein shown and described, applicant claims the benefit of a full range of equivalents within the scope of the appended claims.

I claim:

1. A method of modifying an existing cold storage warehouse for frozen commodities having at least one elevator shaft therein to eliminate ice formation within said shaft comprising:

sealing the upper end of said shaft from air and moisture leakage from the ambient atmosphere exterior to the warehouse;

establishing vestibule means enclosing the elevator doors on each floor to minimize transfer of air from the warehouse to the shaft when opening the elevator doors;

adding heat to said shaft to raise the temperature substantially above that of the warehouse interior; and establishing a recirculating pattern flow of air within said shaft between the top and bottom thereof.

2. In a multi-story cold storage warehouse including at least one elevator shaft and wherein the temperature is maintained at about 0° to −20° F., means for isolating the atmosphere in said shaft from the atmosphere in the warehouse and also from ambient atmosphere;

a solar panel on the roof of said warehouse;

an insulated storage tank and means for circulating fluid from said panel to said tank;

heating pipes extending vertically through said shaft and means for circulating fluid from said tank through said pipes;

a flexible fluid-tight duct extending from the top and opening into the bottom of said shaft; and means for forcing warm air from the upper portion of said shaft downwardly through said duct to the bottom of said shaft.

* * * * *